United States Patent [19]

Miyamoto

[11] Patent Number: 4,992,075

[45] Date of Patent: Feb. 12, 1991

[54] COIN STACKING APPARATUS

[75] Inventor: Katsuyuki Miyamoto, Urawa, Japan

[73] Assignee: Laurel Bank Machines Co., Ltd., Tokyo, Japan

[21] Appl. No.: 449,792

[22] Filed: Dec. 13, 1989

[30] Foreign Application Priority Data

Dec. 22, 1988 [JP] Japan ..... 63-324545
Dec. 6, 1989 [JP] Japan ..... 1-317077

[51] Int. Cl.[5] ..... G07D 9/06

[52] U.S. Cl. ..... 453/61; 53/500; 53/532

[58] Field of Search ..... 453/31, 59, 61, 62; 53/212, 254, 500, 501, 532

[56] References Cited

U.S. PATENT DOCUMENTS

| | | | |
|---|---|---|---|
| 4,040,434 | 8/1977 | Watanabe et al. | 453/62 X |
| 4,220,169 | 9/1980 | Furuya | 453/31 X |
| 4,270,557 | 6/1981 | Watanabe | 453/61 X |
| 4,412,550 | 11/1983 | Watanabe et al. | 453/61 |
| 4,820,237 | 4/1989 | Shinozaki et al. | 453/59 X |
| 4,832,655 | 5/1989 | Sakurai | 453/61 |
| 4,861,312 | 8/1989 | Sentoku | 453/31 X |

*Primary Examiner*—F. J. Bartuska

*Attorney, Agent, or Firm*—Fleit, Jacobson, Cohn, Price, Holman & Stern

[57] ABSTRACT

A coin stacking apparatus for a coin handling machine including a pair of stacking drums, outer peripheries thereof being formed with spiral guides which extend in the opposite directions to each other and in phase and a pulse motor for intermittently rotating the pair of stacking drums so that the spiral guides are intermittently lowered, the coin stacking apparatus being intended to enable the spiral guides to support and stack coins on an upper face thereof, the coin stacking apparatus further including a controller for outputting pulse signals to the pulse motor, thereby to drive it, a reference data memory for storing reference signals to be output from the controller to the pulse motor in accordance with coin denominations and a coin detector provided above the pair of stacking drums for detecting whether or not the coin is accommodated between the pair of stacking drums by detecting whether or not the coin contacts the coin detector, the controller outputting a correction pulse signal to the pulse motor thereby to drive it, when the controller judges based upon a detection signal detected by the coin detector after it outputs the reference pulse signal to the pulse motor that the coin has not been accommodated between the pair of stacking drums. This coin stacking apparatus can prevent coins from jamming therein.

10 Claims, 4 Drawing Sheets

COIN STACKING APPARATUS

CROSS REFERENCE TO RELATED APPLICATIONS

The present invention relates generally to the subject matter of the following prior U.S. Pat. application Ser. No. 07/015,987, filed on Feb. 18, 1987, entitled "Coin Stacking Apparatus", now matured to the U.S. Pat. No. 4,832,655.

1. Background of the Invention

The present invention relates to a coin stacking apparatus for a coin handling machine, and, more particularly, to such an apparatus capable of preventing coins from jamming and of stacking coins in a desired manner.

2. Description of the Prior Art

Japanese Patent Publication No. 62-208329 discloses a coin stacking apparatus for a coin handling machine such as a coin wrapping machine comprising a pair of rotatable stack drums, the shafts of the pair of stacking drums being vertically disposed at a predetermined interval, spiral guides for supporting and stacking coins fed from a coin passage on the upper face thereof, the spiral guides formed on the outer peripheries of the respective stacking drums in such a manner that one spiral extends in the opposite direction to the other but the two spirals extend in phase with each other, and a pulse motor for intermittently rotating the pair of stacking drums in the opposite directions to each other by the same amount of rotation, and capable of stacking coins in the vertical direction, while being inclined.

In this coin stacking apparatus, the distance between the upper and lower ends of each coin in the vertical direction is calculated by assuming that all coins are held on the upper face of the spiral guides in such a manner that they are inclined along the slope of the spiral guides, the number of pulses is determined for driving the pulse motor for one coin so that the spiral guides are lowered by this distance in the vertical direction, and the pulse motor is driven, whereby the stacking drums are rotated for stacking coins.

However, it was found that the angle of coins stacked between the pair of stacking drums depends upon the weight of the coins, the positions of guide members for guiding the coins to be fed to the pair of stacking drums and the number of stacked coins etc. and is not constant, and that the angle of the coins with respect to the horizontal plane varies within the range below the angle of the slope of the spiral guides. Therefore, in the case where the pulse motor is driven in the above described manner, the spiral guides are often lowered too much and, as a result, the space between the uppermost coin and the face of the coin passage in the vertical direction, that is, the space of the coin stacking portion above the uppermost coin, gradually becomes larger in accordance with the increase in the number of the coins stacked between the pair of stacking drums, whereby the following coin tends to stand erect on the upper face of the uppermost coin so that coin jamming tends to occur.

SUMMARY OF THE INVENTION

It is, therefore, an object of the present invention to provide a coin stacking apparatus for a coin handling machine capable of preventing coins from jamming and of stacking coins in a desired manner.

According to the present invention, the above and other objects can be accomplished by a coin stacking apparatus for a coin handling machine comprising a pair of stacking drums, the outer peripheries thereof being formed with spiral guide means which extend in the opposite directions to each other and in phase and a pulse motor for intermittently rotating said pair of stacking drums so that said spiral guide means are intermittently lowered, the coin stacking apparatus being adapted to enable said spiral guide means to support and stack coins on an upper face thereof, said coin stacking apparatus further comprising control means for outputting pulse signals to said pulse motor, thereby to drive it, reference data storing means for storing reference signals to be output from said control means to said pulse motor in accordance with coin denominations and coin detecting means provided above said pair of stacking drums for detecting whether or not the coin is accommodated between said pair of stacking drums by detecting whether or not the coin contacts said coin detecting means, said control means outputting a correction pulse signal to said pulse motor thereby to drive it, when the control means judges based upon a detection signal detected by said coin detecting means after it outputs the reference pulse signal to the pulse motor that the coin has not been accommodated between the pair of stacking drums.

In a preferred aspect of the present invention, said reference pulse of the reference pulse signal is determined so as to be smaller than a pulse number corresponding to the space between the upper and lower ends of the coin when the coin is held along the upper face of the spiral guide means and 1.2 to 1.8 times as large as the thickness of the denomination of coins to be stacked.

In a further preferred aspect of the present invention, the reference pulse of the reference pulse signal is determined so as to represent 1.5 times the thickness of the denomination of the coins to be stacked.

In a further preferred aspect of the present invention, said control means is constituted so as to output a first correction signal to said pulse motor to drive it when it judges based upon the detection signal detected by said coin detecting means after it outputs the reference signal to the pulse motor that the coin has not been accommodated between the pair of stacking drums and then outputs a second correction signal to the pulse motor to drive it when it judges based upon the detection signal detected by the coin detecting means that the coin still has not been accommodated between the pair of stacking drums.

The above and other objects and features of the present invention will become apparent from the following description made with reference to the accompanying drawings.

DESCRIPTION OF THE PREFERRED EMBODIMENTS

Figure 1:
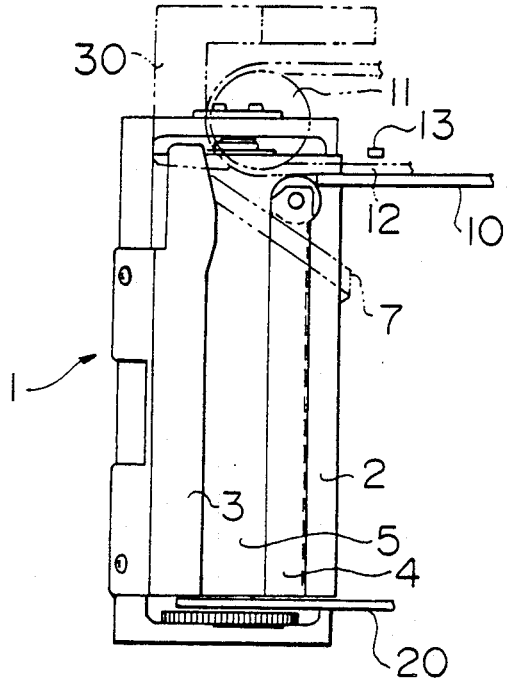
FIG. 1 is a schematic drawing showing a side view of a coin stacking apparatus which is an embodiment of the present invention.
Figure 3:
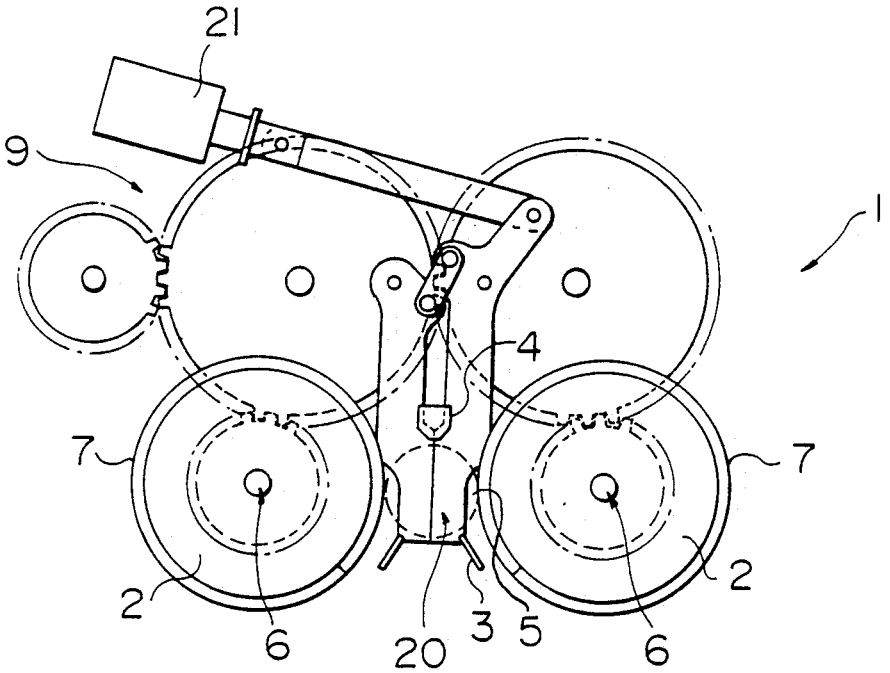
FIG. 3 is a schematic drawing showing a plan view of a coin stacking apparatus which is an embodiment of the present invention.
Figure 2:
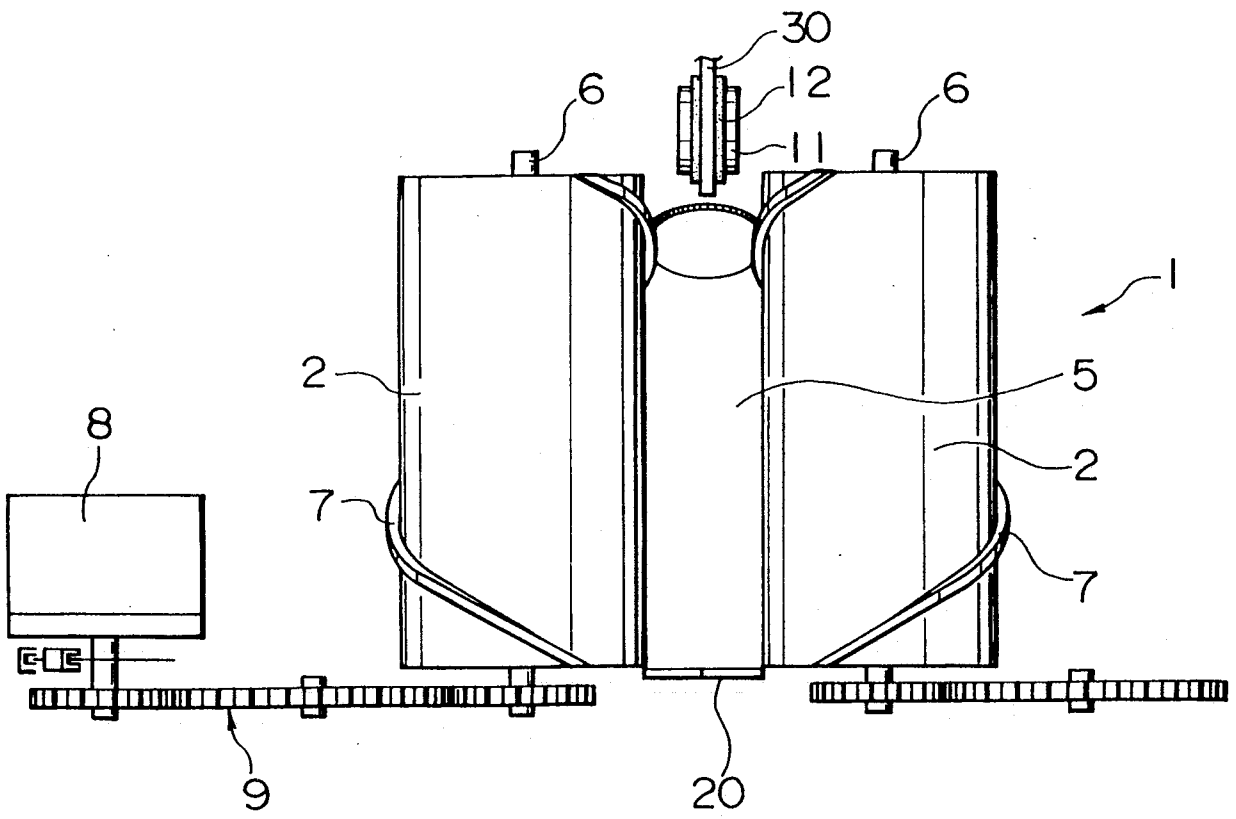
FIG. 2 is a schematic drawing showing a front view of a coin stacking apparatus which is an embodiment of the present invention.

Referring to FIGS. 1 to 3, a coin stacking apparatus 1 which is an embodiment of the present invention is disposed downstream of a coin passage 10 and coins deposited into a coin handling machine via a coin deposit opening (not shown) are fed onto a rotatable disk (not shown) and further fed into a coin sorting apparatus (not shown) one by one. Then coins having other denominations than that designated by an operator are collected and only coins of designated denomination are fed one by one to the coin stacking apparatus 1 via the coin passage 10.

An endless transporting belt 12 engaged with a pulley 11 is provided above the coin passage 10 and the coins are fed to the coin stacking apparatus 1 while being held between the upper face of the coin passage 10 and the endless transporting belt 12.

The coin stacking apparatus 1 comprises a pair of stacking drum 2, 2, a pair of first guide plates 3, 3 provided in the vertical plane and a second guide plate 4 provided on the side of the coin passage 10 with respect to the first guide plates 3, 3 and a coin stacking portion 5 is formed among the pair of stacking drums 2, 2, the pair of first guide plates 3, 3 and the second guide plate 4.

The pair of stacking drums 2, 2 is rotatable about rotatable shafts 6, 6 arranged vertically and the outer peripheries thereof are formed with spiral guides 7, 7 which extend in the opposite directions to each other and in phase. The pair of stacking drums 2, 2 are intermittently rotated by a pulse motor 8 via a transmission mechanism 9 by a predetermined amount in opposite directions to each other in synchronism with the feed-out of coins from the coin passage 10.

The coins fed out from the coin passage 10 to the coin stacking apparatus 1 are received by the upper face of the spiral guides 7, 7 while abutting against the pair of first guide plates 3, 3 and the second guide plate 4 and stacked at an inclination in the coin stacking portion 5.

The positions of the pair of first guide plates 3, 3 and the second guide plate 4 are adjustable in accordance with the denomination of the coins to be stacked.

Below the coin stacking portion 5 between the pair of stacking drums 2, 2, there is provided a shutter 20 which can be opened and closed by a shutter solenoid 21. The coins stacked in the coin stacking portion 5 are supported on the upper face of the shutter 20 and fed to a coin wrapping portion (not shown) where they are wrapped in a roll form when the shutter solenoid 21 is driven to open the shutter 20.

Above the coin passage 10 in the vicinity of the coin stacking apparatus 1, a sensor 13 is provided for counting the number of coins which have been fed to the coin stacking apparatus 1 and outputting coin count signals to the control system (not shown). In the case where the control system judges based upon the coin count signals input from the sensor 13 that the number of coins which have been fed to the coin stacking apparatus 1 becomes equal to the number of coins to be wrapped, it projects a stopper (not shown) into the coin passage 10 to prevent further coins from being fed to the coin stacking apparatus 1.

As shown in FIGS. 1 and 2, a coin detecting member 30 is provided in the vicinity of the pulley 11 on the opposite side of the coin passage 10 so that its outer face is formed along the transporting belt 12 engaged with the pulley 11. The coin detecting member 30 is a member for electrically detecting whether or not a coin has been accommodated within the coin stacking portion 5 and outputs a coin detection signal to a control system (not shown) when the coin contacts the first guide plates 3, 3 or the second guide plate 4 and the coin detecting member 30. In addition, the coin detecting member 30 prevents coins fed from the coin passage 10 to the coin stacking apparatus 1 from going straight and bouncing out.

Figure 4:
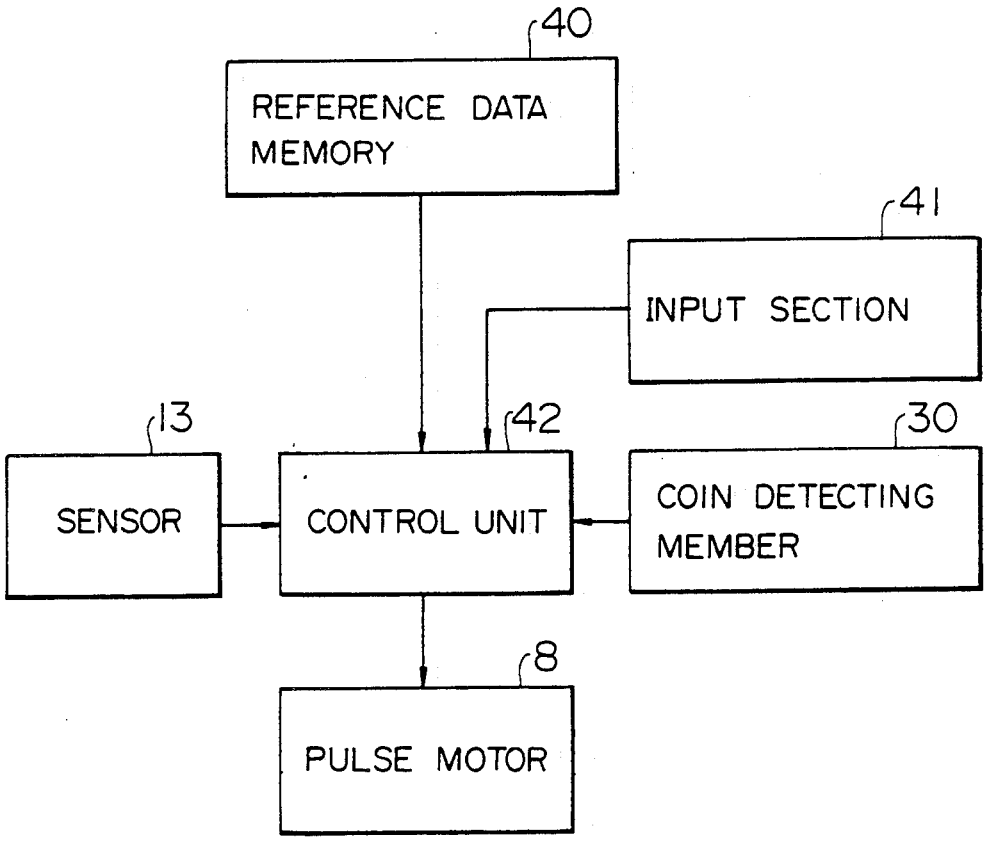
FIG. 4 is a block diagram of a control system of a coin tacking apparatus which is an embodiment of the present invention.

FIG. 4 is a block diagram showing the control system of the coin stacking apparatus which is an embodiment of the present invention.

Referring to FIG. 4, the control system of the coin stacking apparatus which is an embodiment of the present invention comprises a reference data memory 40 for storing reference data for each denomination of coins which are obtained by converting the amount of rotation of the pair of stacking drums necessary for one coin to the number of pulses to be output to the pulse motor, an input section 41 which is operated by an operator and to which the denomination of the coins to be stacked etc. is input, and a control unit 42 which receives stacked coin denomination signals from the input section 41 and coin count signals from the sensor 13, reads out the reference pulse to be output to the pulse motor 8 based upon these input signals to store it therein, outputs the reference pulse to the pulse motor 8 and calculates a correction pulse by correcting the reference pulse based upon the coin detection signal from the coin detecting member 30 to output correction signals to the pulse motor 8, if necessary.

The reference data memory 40 stores a reference pulse N corresponding to a value $(T+t)$ obtained by adding a predetermined value t to the thickness T of the coins to be stacked as the reference data. It is necessary to experimentally determine the value t so that $(T+t)$ is smaller than the space between the upper and lower ends of the coin when the angle of the coin is equal to the slope of the spiral guides 7, 7 and the space between the upper face of the coin and the upper end of the coin stacking portion 5 is smaller than that within which the coin tends to stand erect on the upper face of the uppermost coin. In this embodiment, a reference pulse corresponding to 1.5 times the thickness of the coin, that is, $t=0.5$, is stored in the reference pulse memory 40.

As a consequence, in the case where coins are stacked on the spiral guides 7, 7 of the pair of stacking drums 2, 2 so that their angle is equal to the slope of the spiral guides 7, 7, even if the reference pulse is output to the pulse motor 8 to drive it, it is possible that the spiral guides 7, 7 will not be sufficiently lowered for completely accommodating the coins within the coin stacking portion 5 and the uppermost coin will project above the coin stacking portion 5. However, in this embodiment, since the coin detecting member 30 is provided, in the case where the coin projects above the coin stacking portion 5, the coin contacts the coin detecting member 30 and the coin detection signal is output from the coin detecting member 30 to the control unit 42 and, as a result, the control unit 42 can detect that the spiral guides 7, 7 are not sufficiently lowered. In this case, in this embodiment, the control unit 42 corrects the reference pulse N to calculate a first correction pulse $N_{c1}$ in accordance with the following formula and further outputs a first correction pulse signal to the pulse motor 8 to drive it, thereby to further rotate the pair of stacking drums 2, 2 and lower the spiral guides 7, 7.

$$N_{c1}=N/2$$

Here, since the spiral guides 7, 7 have been lowered by the distance corresponding to the reference pulse N determined as described above, it is possible to completely lowering the spiral guides 7, 7 by a distance corresponding to the first correction pulse $N_{c1}$.

Further, in the case where the coin detection signal is still input from the coin detecting member 30 even after the control unit 42 has output the first correction pulse signal and driven the pulse motor 8, since it is considered that coin jamming has probably occurred and, in this embodiment, the control unit 42 corrects the reference pulse N to calculate a second correction pulse $N_{c2}$ in accordance with the following formula and further outputs a second correction pulse signal to the pulse motor 8 to drive it, thereby to further rotate the pair of stacking drums 2, 2 and lower the spiral guides 7, 7.

$$N_{c2}=2N$$

Here, in the case where the reference pulse N is determined so as to correspond to 1.5 times the thickness T of the denomination of the coins to be stacked, if the second correction pulse $N_{c2}$ is set so as to be twice the reference pulse N, it is experimentally confirmed that the spiral guides 7, 7 are sufficiently lowered and coin jamming can be eliminated.

Figure 5:
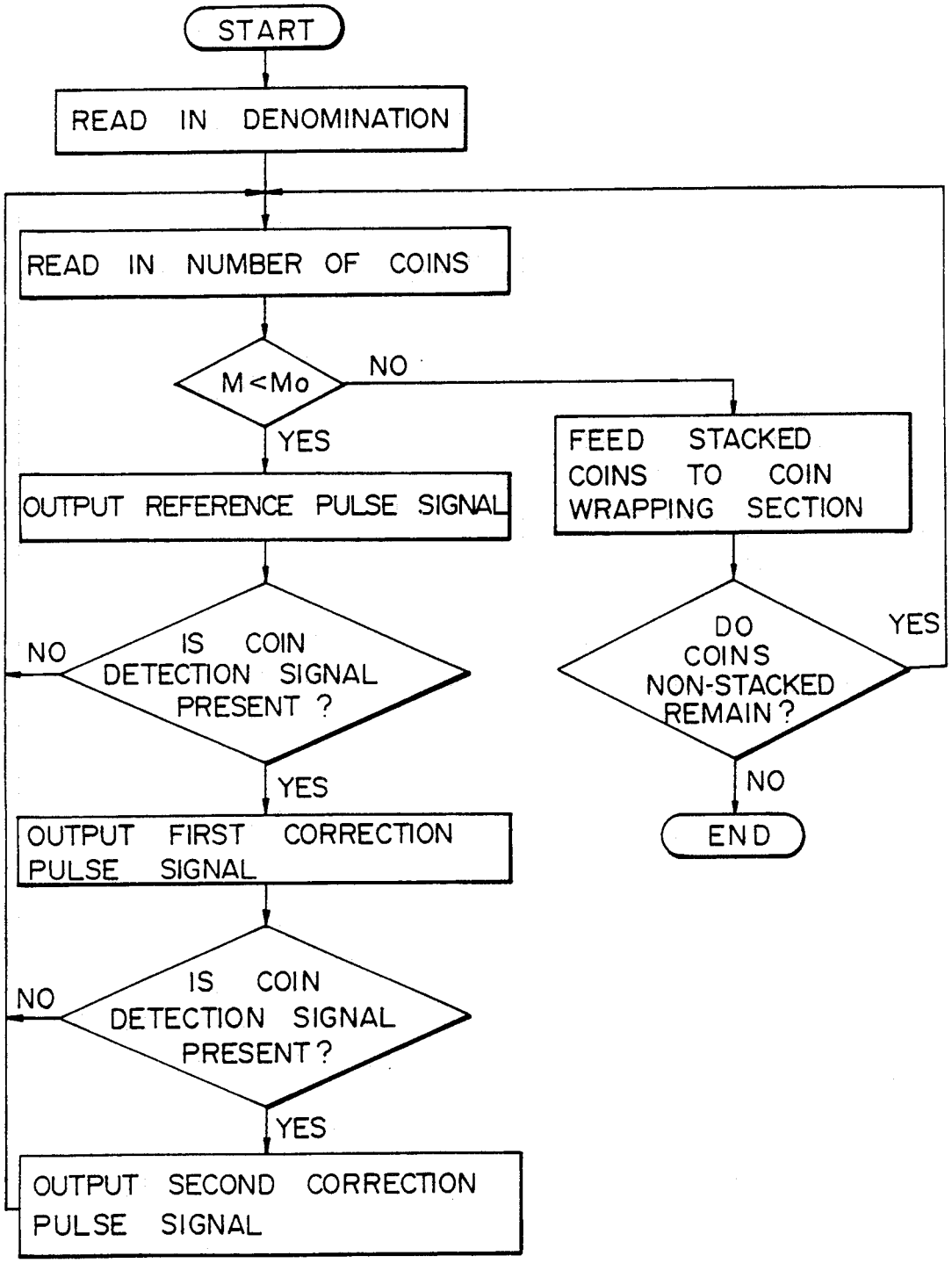
FIG. 5 is a flow chart showing a control routine of a coin stacking apparatus which is an embodiment of the present invention.

FIG. 5 is a flow chart showing a control routine of the coin stacking apparatus which is an embodiment of the present invention.

Referring to FIG. 5, firstly, the control unit 42 reads out a stacked coin denomination signal input to the input section 41 and then the number M of coins which have been fed to the coin stacking apparatus 1 is counted by the sensor 13 to be output to the control unit 42.

The control unit 42 reads out the reference data from the reference data memory 40 based upon the stacked coin denomination signal, outputs the reference pulse signal to the pulse motor 8 and drives the pulse motor 8 by the reference pulse N.

Then, the control unit 42 judges whether or not the coin detection signal is input from the coin detecting member 30.

As a result, when no coin detection signal is input, in other words, no coin contacts the coin detecting member 30, since it can be considered that the coin has been completely accommodated within the coin stacking portion 5, the control operation will be carried out for the next coin stacking operation.

On the contrary, when the coin detection signal is being input from the coin detecting member 30, since it can be considered that the coin fed to the coin stacking portion 5 has not been accommodated within the coin stacking portion 5, the control unit 42 corrects the reference pulse N to obtain the first correction pulse $N_{c1}$ in accordance with the following formula, outputs the first correction signal to the pulse motor 8 and drives the pulse motor 8 by the first correction pulse $N_{c1}$.

$$N_{c1}=N/2$$

Afterward, the control unit 42 further judges whether or not the coin detection signal is being input from the coin detecting member 30.

As a result, when the coin detection signal is being not input, since it can be considered that the coin has been completely accommodated within the coin stacking portion 5 by driving the pulse motor 8 by the first correction pulse $N_{c1}$, the control operation will be carried out for the next coin stacking operation.

On the other hand, when the coin detection signal is being input from the coin detecting member 30, it can be assumed that the coin still contacts the coin detecting member 30 although the pulse motor 8 has been driven by the first correction pulse $N_{c1}$. Since, as described above, the first correction pulse $N_{c1}$ is determined as a value sufficient of eliminating the projection of the coin above the coin stacking portion 5 caused by determining the reference pulse so as to lower the spiral guides 7, 7 by the distance corresponding to (T+t), it can be assumed that the fact that the coin still contacts the coin detecting member 30 even though the pulse motor 8 has been driven by the first correction pulse $N_{c1}$ means that coin jamming has occurred in the coin stacking portion 5. Therefore, in this case, the control unit 42 judges that coin jamming has occurred, corrects the reference pulse N to obtain the second correction pulse $N_{c2}$ in accordance with the following formula, outputs the second correction pulse signal to the pulse motor 8 and drives the pulse motor 8 by the second correction pulse $N_{c2}$.

$$N_{c2}=2N$$

As described above, since the second correction pulse $N_{c2}$ is experimentally selected as a value corresponding to an amount for lowering the spiral guides 7, 7 sufficient for eliminating the coin jamming, the control unit 42 judges that the coin jamming has been eliminated and the coin has been completely accommodated within the coin stacking portion 5 and the control operation will be carried out for the next coin stacking operation.

Thus, when the control unit 42 judges that a predetermined number Mo of coins to be stacked have been fed to the coin stacking portion 5 and stacked therein, it projects the stopper (not shown) into the coin passage 10 to prevent further coins from being fed t the coin stacking portion 5. Then, the coins stacked in the coin stacking portion 5 are received by the upper face of the shutter 20, fed to the coin wrapping portion (not shown) by opening the shutter 20 by the shutter solenoid 21 and wrapped in a roll form. Afterward, the coin stacking operation is restarted for the remaining coins in the coin handling machine.

Thus, when all coins deposited into the coin handling machine have been stacked, the coin stacking operation is completed.

As described above in detail with reference to the accompanying drawings, according to this embodiment, since the reference pulse N is set so as to be a value corresponding to 1.5 times the thickness T of the coins to be stacked, it is possible to prevent the spiral guides 7, 7 from being lowered too much and since the space between the upper face of the uppermost coin and the upper end of the coin stacking portion 5 cannot become too large, it is possible to prevent the coin fed to the coin stacking portion 5 from standing erect on the upper face of the uppermost coin. Further, in the case where the coin projects above the upper end of the coin stacking portion 5 because the reference pulse is determined in the above described manner, such coin projection is detected by the coin detecting member 30 and the first correction pulse signal is output, thereby to drive the pulse motor 8 by the first correction pulse $N_{c1}$ corresponding to half of the reference pulse N so that the coin can be completely accommodated within the coin stacking portion 5. Moreover, in the case where coin jamming has occurred for some reason, since the second correction pulse signal is output, thereby to drive the pulse motor 8 by the second correction pulse $N_{c2}$ corresponding to twice the reference pulse N and considerably lower the spiral guides 7, 7, it is possible to easily eliminate coin jamming.

As explained in detail with reference to the preferred embodiment, according to the present invention it is possible to provide a coin stacking apparatus for a coin handling machine capable of preventing coins from jamming and of stacking coins in a desired manner.

The present invention has thus been shown and described with reference to a specific embodiment. However, it should be noted that the present invention in no way limited to the details of the described arrangements but changes and modifications may be made without departing from the scope of the appended claims.

For example, in the above described embodiment, although the reference pulse N is determined to be a value corresponding to 1.5 times the thickness T of coins, the reference pulse N can be experimentally determined so that when the pulse motor 8 is driven based thereupon, the space between the upper face of the uppermost coin and the upper end of the coin stacking portion 5 is smaller than that within which the coin tends to stand erect on the upper face of the uppermost coin and the coin can be completely accommodated within the coin stacking portion 5 without frequent output of the second correction pulse signal, and, therefore, it is not limited to the value corresponding to 1.5 times the thickness T of the denomination of the coins to be stacked. In general, in cases where the reference pulse N is set to be smaller value, in other words, t is set to be smaller value, the space between the upper face of the uppermost coin and the upper end of the coin stacking portion 5 can be kept sufficiently small and it is possible to prevent coins from standing erect on the upper face of the uppermost coin without fail. On the other hand, in this case, since the coin often cannot be accommodated within the coin stacking portion 5, it is necessary to frequently output the first correction pulse signal and this is very troublesome. On the contrary, in cases where the reference pulse N is set to be larger, in other words, t is set to be larger, although it is easy to completely accommodate the coin within the coin stacking portion 5, since the space between the upper face of the uppermost coin and the upper end of the coin stacking portion 5 becomes larger when the pulse motor 8 is driven based upon the reference pulse signal, the coin tends to stand erect on the upper face of the uppermost coin and there arises a problem that coin jamming tends to occur. In this sense, it is usually preferable to set the reference pulse N to be a value corresponding to 1.2 to 1.8 times as large as the thickness T of coins to be stacked.

Further, in the above described embodiment, although in the case where it is judged based upon the coin detection signal from the coin detecting member 30 that the coin has not been completely accommodated within the coin stacking portion 5 and projects above the coin stacking portion 5, the pulse motor 8 is driven by the first correction pulse $N_{c1}$ equal to half of the reference pulse N, the relationship between the first correction pulse $N_{c1}$ and the reference pulse N depends upon how the reference pulse N is set and is not always constant. More specifically, in cases where the reference pulse N is set to be larger, the first correction pulse $N_{c1}$ may be set to be smaller than half of the reference pulse N and, on the other hand, in cases where the reference pulse N is set to be smaller, it may be necessary to set the first correction pulse $N_{c1}$ to be greater than half of the reference pulse N. Further, in the above described embodiment, although in the case where the coin detecting member 30 still detects the coin although it is judged based upon the coin detection signal from the coin detecting member 30 that the coin has not been completely accommodated within the coin stacking portion 5 and projects above the coin stacking portion 5 and the first correction pulse signal is output to the pulse motor 8 whereby the pulse motor 8 is driven, it is judged that the coins have jammed in the coin stacking portion 5 and the pulse motor 8 is further driven by the second correction pulse $N_{c2}$ equal to twice the reference pulse N, the relationship between the second correction pulse $N_{c2}$ and the reference pulse N depends upon how the reference pulse N is set and is not always constant. More specifically, in cases where the reference pulse is set to be larger, the second correction pulse $N_{c2}$ is smaller than twice the reference pulse N and, on the other hand, in cases where the reference pulse N is set to be greater, it may be necessary to set the second correction pulse $N_{c2}$ to be greater than twice the reference pulse N. At any rate, the first correction pulse $N_{c1}$ and the second correction pulse $N_{c2}$ can be experimentally and easily determined in relation to the reference pulse N.

Moreover, in the above described embodiment, although after the reference pulse signal was output to the pulse motor 8 and the spiral guides 7, 7 were lowered, when the coin detecting member 30 contacts the coin and the coin detection signal is input from the coin detecting member 30, the control unit 42 outputs the first correction pulse signal, further drives the pulse motor 8 based thereupon and lowers the spiral guides 7, 7 and in the case where nevertheless, the coin detecting member 30 still contacts the coin, it judges that coin jamming has occurred, outputs the second correction pulse signal and further drives the pulse motor 8, in the case where the first correction pulse $N_{c1}$ is set to be smaller, when the coin detection signal is being input from the coin detecting member 30 after the first correction pulse signal was output once, it is not judged that coin jamming has occurred but it may be judged that coin jamming has occurred when the coin detection signal is being input from the coin detecting member 30 after the first correction pulse signal was output a predetermined number of times over twice and the second correction pulse signal may be output.

Furthermore, in the above described embodiment, in the case where it is judged that coin jamming occurred and the second correction pulse signal is therefore output and the pulse motor driven, it is deemed that coin jamming was eliminated and the control operation is carried out for the next coin stacking operation. Alternatively, however, it is possible to judge whether or not coin jamming has been eliminated based upon the coin detection signal from the coin detecting member 30 after the second correction pulse signal was output and the pulse motor 8 was driven and open the coin stacking apparatus 1 to remove the jammed coins manually when the coin detection signal is still being input. Further, when the coin detection signal is still being input even after the second correction pulse signal was output once or several times, the jammed coins may be removed manually by opening the coin stacking apparatus 1.

I claim:

1. A coin stacking apparatus for a coin handling machine comprising a pair of stacking drums, outer peripheries thereof being formed with spiral guide means which extend in opposite directions to each other and in phase and a pulse motor for intermittently rotating said pair of stacking drums so that said spiral guide means are intermittently lowered, the coin stacking apparatus being adapted to enable said spiral guide means to support and stack coins on an upper face thereof, said coin stacking apparatus further comprising control means for outputting pulse signals to said pulse motor, thereby to drive it, reference data storing means for storing reference pulse signals to be output from said control means to said pulse motor to lower said spiral guide means in accordance with coin denominations and coin detecting means provided above said pair of stacking drums for detecting whether or not the coin is accommodated between said pair of stacking drums by detecting whether or not the coin contacts said coin detecting means, said control means outputting a correction pulse signal to said pulse motor thereby to drive it, when the control means judges based upon a detection signal detected by said coin detecting means after it outputs the reference pulse signal to the pulse motor that the coin has not been accommodated between the pair of stacking drums.

2. A coin stacking apparatus in accordance with claim 1 wherein the reference pulse signal is derived from a reference pulse having a value smaller than a pulse number corresponding to a space between upper and lower ends of the coin when the coin is held along the upper face of the spiral guide means and 1.2 to 1.8 times as large as the thickness of the denomination of the coins to be stacked.

3. A coin stacking apparatus in accordance with claim 2 wherein said reference pulse of the reference pulse signal is determined so as to be 1.5 times the thickness of the denomination of the coins to be stacked.

4. A coin stacking apparatus in accordance with claim 1 wherein said control means is constituted so as to output a first correction signal to said pulse motor to drive it when it judges based upon the detection signal detected by said coin detecting means after it outputs the reference signal to the pulse motor that the coin has not been accommodated between the pair of stacking drums and then outputs a second correction signal to the pulse motor to drive it when it judges based upon the detection signal detected by the coin detecting means that the coin still has not been accommodated between the pair of stacking drums.

5. A coin stacking apparatus in accordance with claim 2 wherein said control means is constituted so as to output a first correction signal to said pulse motor to drive it when it judges based upon the detection signal detected by said coin detecting means after it outputs the reference signal to the pulse motor that the coin has not been accommodated between the pair of stacking drums and then outputs a second correction signal to the pulse motor to drive it when it judges based upon the detection signal detected by the coin detecting means that the coin still has not been accommodated between the pair of stacking drums.

6. A coin stacking apparatus in accordance with claim 3 wherein said control means is constituted so as to output a first correction signal to said pulse motor to drive it when it judges based upon the detection signal detected by said coin detecting means after it outputs the reference signal to the pulse motor that the coin has not been accommodated between the pair of stacking drums and then outputs a second correction signal to the pulse motor to drive it when it judges based upon the detection signal detected by the coin detecting means that the coin still has not been accommodated between the pair of stacking drums.

7. A coin stacking apparatus in accordance with claim 5 wherein said first correction pulse signal is derived from a first correction pulse having a value set 1/m (m being a positive integer) of the value of the reference pulse of said reference pulse signal and said second correction pulse signal is derived from a second correction pulse having a value set n times (n being a positive integer) as large as the value of the reference pulse of the reference pulse signal.

8. A coin stacking apparatus in accordance with claim 6 wherein said first correction pulse signal is derived from a first correction pulse having a value set 1/m (m being a positive integer) of the value of the reference pulse of said reference pulse signal and said second correction pulse signal is derived from a second correction pulse having a value set n times (n being a positive integer) as large as the value of the reference pulse of the reference pulse signal.

9. A coin stacking apparatus in accordance with claim 7 wherein said m is 2 and said n is 2.

10. A coin stacking apparatus in accordance with claim 8 wherein said m is 2 and said n is 2.

* * * * *